US007497808B2

(12) United States Patent
Eschenbach

(10) Patent No.: US 7,497,808 B2
(45) Date of Patent: Mar. 3, 2009

(54) STEP THRU RECUMBENT ELLIPTICAL EXERCISE APPARATUS

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 330 days.

(21) Appl. No.: 11/511,058

(22) Filed: Aug. 28, 2006

(65) Prior Publication Data

US 2007/0161465 A1 Jul. 12, 2007

Related U.S. Application Data

(63) Continuation-in-part of application No. 11/329,950, filed on Jan. 12, 2006.

(51) Int. Cl.
*A63B 22/04* (2006.01)
*A63B 22/06* (2006.01)

(52) U.S. Cl. ..... 482/52; 482/51; 482/57

(58) Field of Classification Search ..... 482/51–53, 482/57, 70, 79–80

See application file for complete search history.

(56) References Cited

U.S. PATENT DOCUMENTS

| | | | | | |
|---|---|---|---|---|---|
| 5,039,088 | A * | 8/1991 | Shifferaw | 482/51 |
| 5,106,081 | A | 4/1992 | Webb | 482/137 |
| 5,356,356 | A | 10/1994 | Hildebrandt | 482/62 |
| 5,514,053 | A | 5/1996 | Hawkins | 482/63 |
| 5,611,758 | A | 3/1997 | Rodgers, Jr. | 482/57 |
| 5,653,662 | A * | 8/1997 | Rodgers, Jr. | 482/52 |
| 5,836,855 | A | 11/1998 | Eschenbach | 482/57 |
| 5,916,065 | A * | 6/1999 | McBride et al. | 482/57 |
| 5,938,570 | A | 8/1999 | Maresh | 482/57 |
| 6,017,295 | A * | 1/2000 | Eschenbach | 482/57 |
| 6,042,518 | A | 3/2000 | Hildebrandt | 482/57 |
| 6,077,197 | A * | 6/2000 | Stearns et al. | 482/52 |
| 6,283,895 | B1 | 9/2001 | Stearns et al. | 482/52 |
| 6,409,635 | B1 | 6/2002 | Maresh et al. | 482/57 |
| 6,547,701 | B1 * | 4/2003 | Eschenbach | 482/57 |
| 6,666,799 | B2 | 12/2003 | Hildebrandt | 482/57 |
| 6,790,162 | B1 | 9/2004 | Ellis et al. | 482/51 |
| 6,932,745 | B1 | 8/2005 | Ellis | 482/52 |
| 7,364,532 | B2 * | 4/2008 | Maresh | 482/52 |
| 2004/0259692 | A1 | 12/2004 | Martin et al. | 482/52 |

* cited by examiner

*Primary Examiner*—Steve R Crow

(57) ABSTRACT

The present invention relates to a recumbent exercise apparatus that provides elliptical foot exercise with arm exercise. More particularly, the present invention relates to an exercise machine having separately supported pedals for the feet and arm exercise coordinated with the motion of the feet. The pedals articulate to provide lower leg exercise with the heel and toe remaining in contact with the pedal while the pedals move along an inclined elliptical pedal curve. Arm exercise is adjustable to accommodate different size operators. A step through region free of linkage is provided for easy ingress and egress.

20 Claims, 6 Drawing Sheets

STEP THRU RECUMBENT ELLIPTICAL EXERCISE APPARATUS

This application is a Continuation-in-Part of U.S. patent application Ser. No. 11/329,950 filed Jan. 12, 2006 incorporating all of these by reference.

FIELD

The present invention relates to a sit down exercise apparatus operated in a semi-recumbent position where foot operated pedals follow an oblong pedal path. More particularly, the present invention relates to an exercise machine having separately supported pedals for the feet and arm exercise coordinated with motion of the feet.

STATE OF THE ART

The benefits of regular exercise to improve overall health, appearance and longevity are well documented in the literature. For exercise enthusiasts, the search continues for safe apparatus that provides full body exercise for maximum benefit in minimum time. Furthermore, the aging population tends to favor semi-recumbent forms of exercise that encourage muscle tone.

The sit down exercise cycle is the most commonly used apparatus today to elevate the heart rate and exercise some of the leg muscles. To achieve any significant benefit, however, an extensive amount of time is demanded of the user resulting in boredom. To reduce the time needed to elevate the heart rate and exercise additional muscles, various forms of hand cranks and arm levers have been added to sit-down exercise cycles.

In recent years, semi-recumbent or more commonly referred to as recumbent exercise apparatus have appeared that provide for back and forth pedal movement to replace the traditional bike crank. Hawkins in U.S. Pat. No. 5,514,053 shows pedals that move back and forth along a linear path. Webb in U.S. Pat. No. 5,106,081 shows a leg exercise machine with pedals that move back and forth along an arc path. Hildebrandt et al. in U.S. Pat. No. 5,356,356 shows pedals that move back and forth along a circular path with arm exercise. Hildebrandt et al. in U.S. Pat. Nos. 6,042,518, 6,666,799 and Ellis et al. in U.S. Pat. No. 6,790,162 show back and forth pedal movement for a recumbent exerciser. Ellis in U.S. Pat. No. 6,932,745 also shows pedals that provide back and forth movement along a circular arc.

Another group of recumbent exercisers are emerging that use elliptical pedal movement for the feet. Rodgers, Jr. in U.S. Pat. No. 5,611,758 shows a recumbent exercise apparatus to generate an elliptical pedal movement using a crank, reciprocating member and roller/track to guide a pedal/foot member pivotally connected to the reciprocating member and a handle member. Eschenbach in U.S. Pat. No. 5,836,855, Maresh in U.S. Pat. Nos. 5,938,570 and 6,409,635 show elliptical foot motion for recumbent seated operation. Martin et al. in Pat. Application No. US 2004/0259692 shows pedal movements for a semi-recumbent exerciser. Stearns et al. in U.S. Pat. Nos. 6,077,197 and 6,283,895 show inclined pedals with elliptical movement for an operator leaning against a back support. McBride et al. in U.S. Pat. No. 5,916,065 shows elliptical pedal movement intended for stand-up operation in a seated position.

There is a need for a recumbent cycle that has an inclined elliptical pedal path configured to better utilize the range of leg and foot motion. There is also a need to articulate the pedals to provide dorsi-flexion and plantar flexion foot exercise without raising the heel or toe from the pedal. There is a further need to coordinate arm exercise with the elliptical foot pedal path exercise for total body exercise that can be adjusted to accommodate the size of the operator. There is a further need to facilitate startup when one pedal is in a toggle position. There is a further need to free the region between the pedals and the seated operator of moving links for easy ingress and egress.

SUMMARY OF THE INVENTION

The present invention relates to the kinematic motion control of pedals which provide extended leg exercise for semi-recumbent exercise. More particularly, apparatus is provided that offers variable intensity exercise through leg operated cyclic motion in which the pedal supporting each foot is guided through successive positions during the motion cycle while a load resistance acts upon the mechanism. Linkage is provided to coordinate arm exercise. A seat is provided adjustably supported by the framework to locate the operator in a generally semi-recumbent position. The seat can swivel to allow side access as well as a step through feature for easy ingress and egress. The step through region between the pedals and the seat is designed to be free of moving links.

The pedals are guided through an oblong or elongate curve motion during operation by a seated operator in a semi-recumbent position. The generally elliptical or elongate pedal curve is inclined towards the operator to maintain the leg force tangent to the curve during operation to improve energy transfer from the leg muscles to the pedal motion control mechanism. The toe and heel of the operator generally remain in contact with the pedal while the pedal articulates for dorsi-flexion and plantar flexion exercise. The pedal surface remains generally perpendicular to the lower leg to maintain toe and heel contact.

Arm exercise is by arm levers coordinated with the mechanism guiding the foot pedals. An adjustment mechanism is provided allowing the arm exercise to be closer or further away from the operator while maintaining the range of handle movement.

In the first alternate embodiment, the apparatus includes a separate pedal for each foot, each pedal being inclined and attached to a foot support which is pivotally connected to a coupler link and a guide link that is pivotally connected to a rocker link. The coupler link is pivotally connected to a rotary crank arm and pivotally connected to a rocker link, which is pivotally connected to the frame. The crank arm completes one full revolution during a pedal cycle and can be phased generally opposite the crank arm for the other pedal through a bearing journal attached to the framework forming a crank pivot axis. The crank arms can also be connected at the pivot axis so as to be non-parallel for easy startup when one pedal is in a lowermost position. The crank arm, coupler link and rocker link form a crank-rocker linkage where the coupler link will generate elliptical paths.

Load resistance is provided by friction resistance upon a flywheel which can be adjusted manually or by a control system. A pulley attached to a crank arm engages the flywheel by a belt. Other forms of load resistance such as magnetic, alternator, air fan, etc. may also be used.

Handles for arm exercise are adjustably attached to the handle supports. Each handle can slide relative to the handle support to reposition the handle relative to the operator. A locking device secures the handle to the handle support during operation. The handle support is pivotally connected to a first and a second arm link. Both the first and second arm links are pivotally connected to the frame; however, the first arm link extends beyond the frame pivot pivotally connecting to a connector link. The connector link is pivotally connected to the rocker link.

The swivel seat is movably attached to the framework and is adjustable by conventional means. The handles are phased relative to the foot support members to allow the operator to relocate the foot support member for a smooth startup without a toggle condition the can occur between the crank arm and coupler link when they align.

In the second alternate embodiment, the guide link becomes pivotally connected to the framework and the crank arms are non-parallel for easy startup. The remainder of the second alternate embodiment is similar to the preferred embodiment.

In summary, this invention provides the operator with coordinated semi-recumbent exercise of both the hands and feet through extended motions without joint impact. The angle of incline for the elliptical pedal curve is chosen for an operator friendly range of exercise. The handles for arm exercise can be repositioned closer or further away from the operator as desired. Should a toggle condition occur during startup for one of the pedals, force applied to the other pedal will allow the operator to initiate start up. The step through feature allows easy ingress and egress for an operator.

DETAILED DESCRIPTION OF THE EMBODIMENTS

Figure 1:
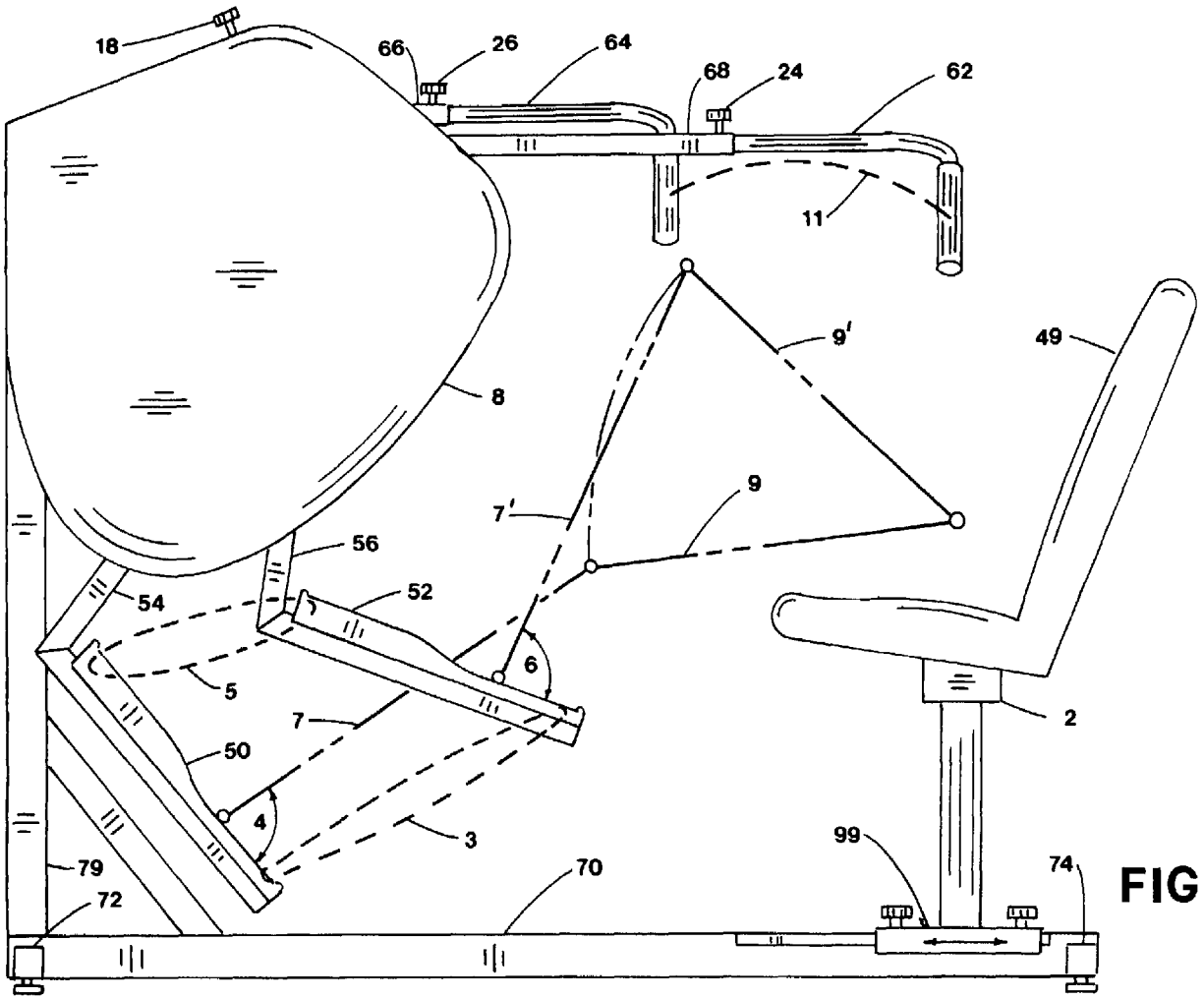
FIG. 1 is a left side elevation view of the preferred embodiment of an exercise machine with shroud constructed in accordance with the present invention.

Referring to the drawings in detail, pedals 50, 52 are shown in FIG. 1 in their most forward and rearward positions of the preferred embodiment. During operation of the exercise apparatus, pedals 50, 52 follow the inclined elliptical pedal curve 5 for the toe and 3 for the heel. The lower leg 7 and upper leg 9 are shown in the lowermost contact with pedal 50 while lower leg 7' and upper leg 9' are shown in the uppermost contact with pedal 52. The angles 4, 6 as measured from the pedal 50, 52 surface to the lower leg 7, 7' remain close to 90 degrees during operation for effective force transfer during load but can articulate approximately plus or minus 10 degrees to exercise the ankle and lower leg muscles. Note that elongate heel curve 3 is longer than elongate toe curve 5.

Handles 62, 64 follow arcuate path 11 coordinated with the movement of pedals 50, 52. Locking devices 24, 26 can be loosened to allow handles 62, 64 to slide relative to handle supports 66, 68 to bring the arcuate path 11 closer or further away from the operator as desired. Handles 60, 62 can also be removed from handle supports 66, 68 if desired. Shroud 8 is slotted to allow movement of handle supports 66, 68 and foot supports 54, 56. With either handle 62, 64 forward, an operator can easily step into the seat or with handles 62, 64 positioned side by side, an operator can step through from either side for easy ingress and egress.

Figure 2:
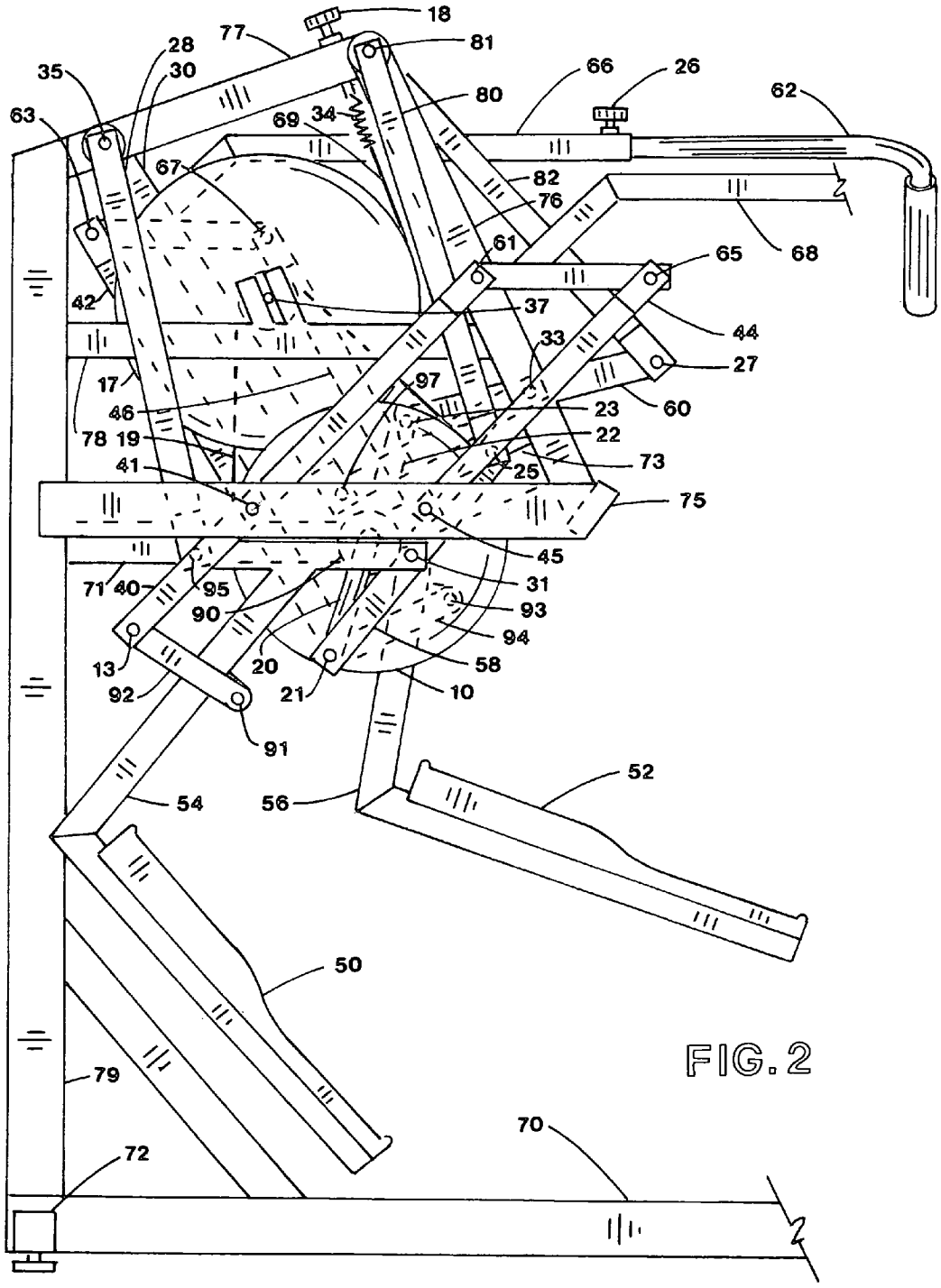
FIG. 2 is the side view of the forward portion of the preferred embodiment without shroud shown in FIG. 1.
Figure 3:
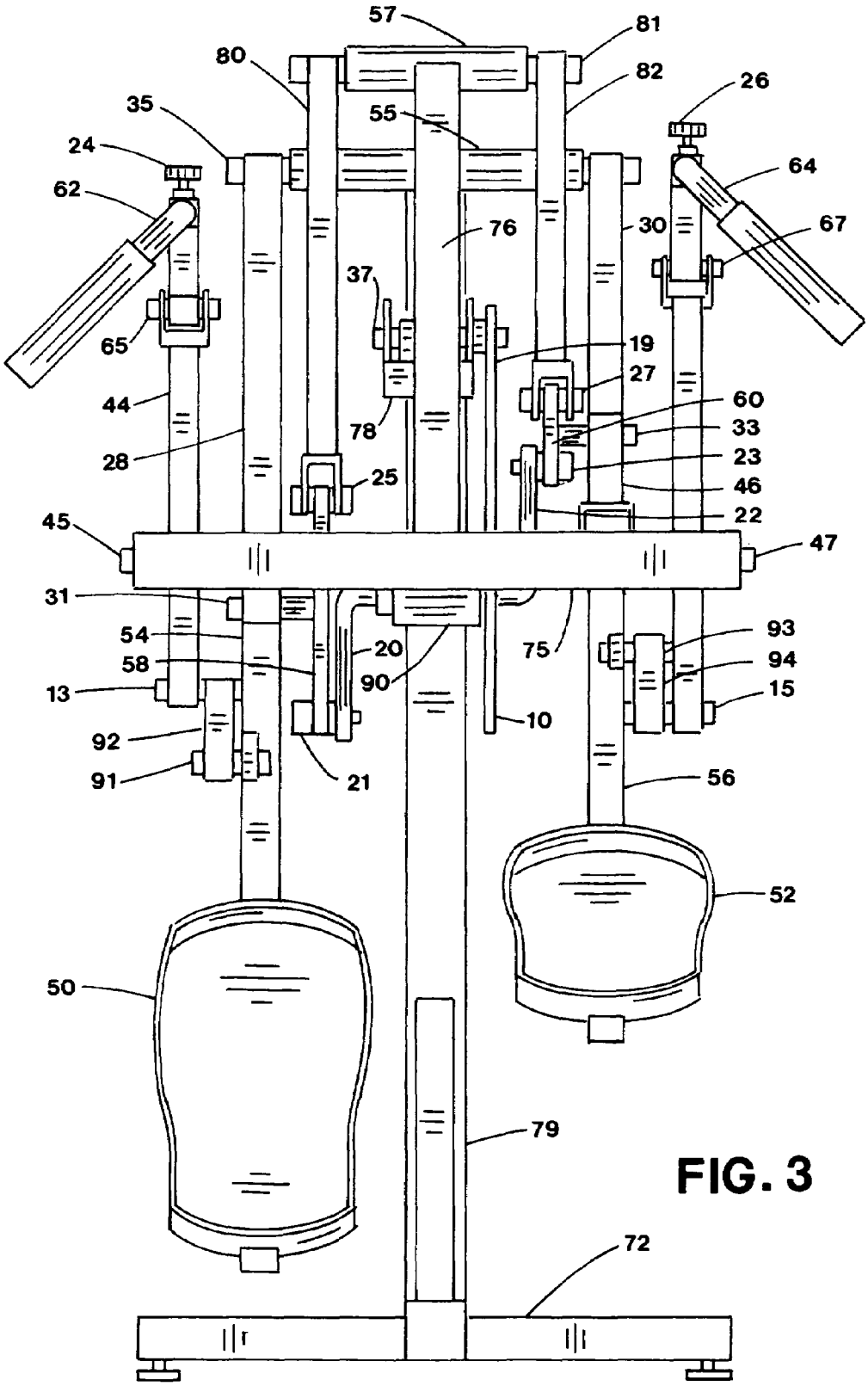
FIG. 3 is a rear view of the preferred embodiment of the present invention shown in FIG. 2 without the seat.

Referring to the forward portion of the preferred embodiment shown in FIGS. 2 and 3, pedals 50, 52 are attached to inclined foot support members 54, 56 which are connected to coupler links 58, 60 at pivots 31, 33 and to first rocker links 28, 30 at pivots 95, 97. First rocker links 28, 30 are connected to frame member 55 at pivot 35. Coupler links 58, 60 are connected to crank arms 20, 22 at pivots 21, 23 and to second rocker links 80, 82 at pivots 25, 27. Second rocker links 80, 82 are attached to frame member 57 at pivot 81.

Crank arms 20, 22 are connected generally opposed in crank bearing housing 90 forming a crank pivot axis. Crank bearing housing 90 is attached to frame members 71 and 73. Crank arms 20, 22, coupler links 58, 60, and second rocker links 80, 82 form a crank-rocker mechanism where the pivots 31, 33 located upon coupler links 58, 60 follow an elliptical path (not shown for clarity). The elliptical motion of coupler link pivots 31, 33 impart elliptical motion to foot support members 54, 56 along with pedals 50, 52. During operation, pedals 50, 52 articulate providing modest dorsi-flexion and plantar flexion foot rotation about the ankle.

Crank arms 20, 22 and coupler links 58, 60 are shown in toggle positions in FIGS. 2 and 3. An operator seated in seat 49 with feet positioned on pedals 50, 52 could have difficulty overcoming the toggle position during startup. To avoid a difficult start, handles 62, 62 are somewhat out of phase with pedals 50, 52 to move crank arms 20, 22 for better force transmission from the coupler links 58, 60 to crank arms 20, 22 once the feet are applying force upon pedals 50, 52.

Pulley 10 is attached to crank arm 22 to rotate about the pivot axis. Flywheel 17 is connected to frame member 78 at pivot 37 and is engaged with pulley 10 by belt 19. Once the pedals 50, 52 are moving, the momentum of flywheel 17 supplies energy to drive through the toggle positions without notice by the operator. Adjustable load resistance is provided by friction band 69 acting upon flywheel 17 with spring 34 and adjustment knob 18.

Frame members 72, 74 are configured to rest on a horizontal surface and are connected by frame member 70. Frame members 55, 57, 70, 71, 73, 75, 76, and 79 are interconnected for the framework. Seat 49 as shown in FIG. 1 is movably attached to frame member 70 by seat support 99 for adjustment of operator leg length. Rotation device 2 allows seat 49 to swivel for side access.

Arm exercise is provided by handles 62, 64 shown in FIGS. 1, 2 and 3. Handles 62, 64 are adjustably connected to handle supports 66, 68. First arm links 40, 42 are connected to handle supports 66, 68 at pivots 61, 63 and to frame member 75 at pivots 41, 43. First arm links 40, 42 further extend beyond pivots 41, 43 to connect to connector links 92, 94 at pivots 13, 15. Connector links 92, 94 are connected to foot support members 54, 56 at pivots 91, 93. Second arm links 44, 46 are connected to handle supports 66, 68 at pivots 65, 67 and to frame member 75 at pivots 45, 47.

Figure 4:
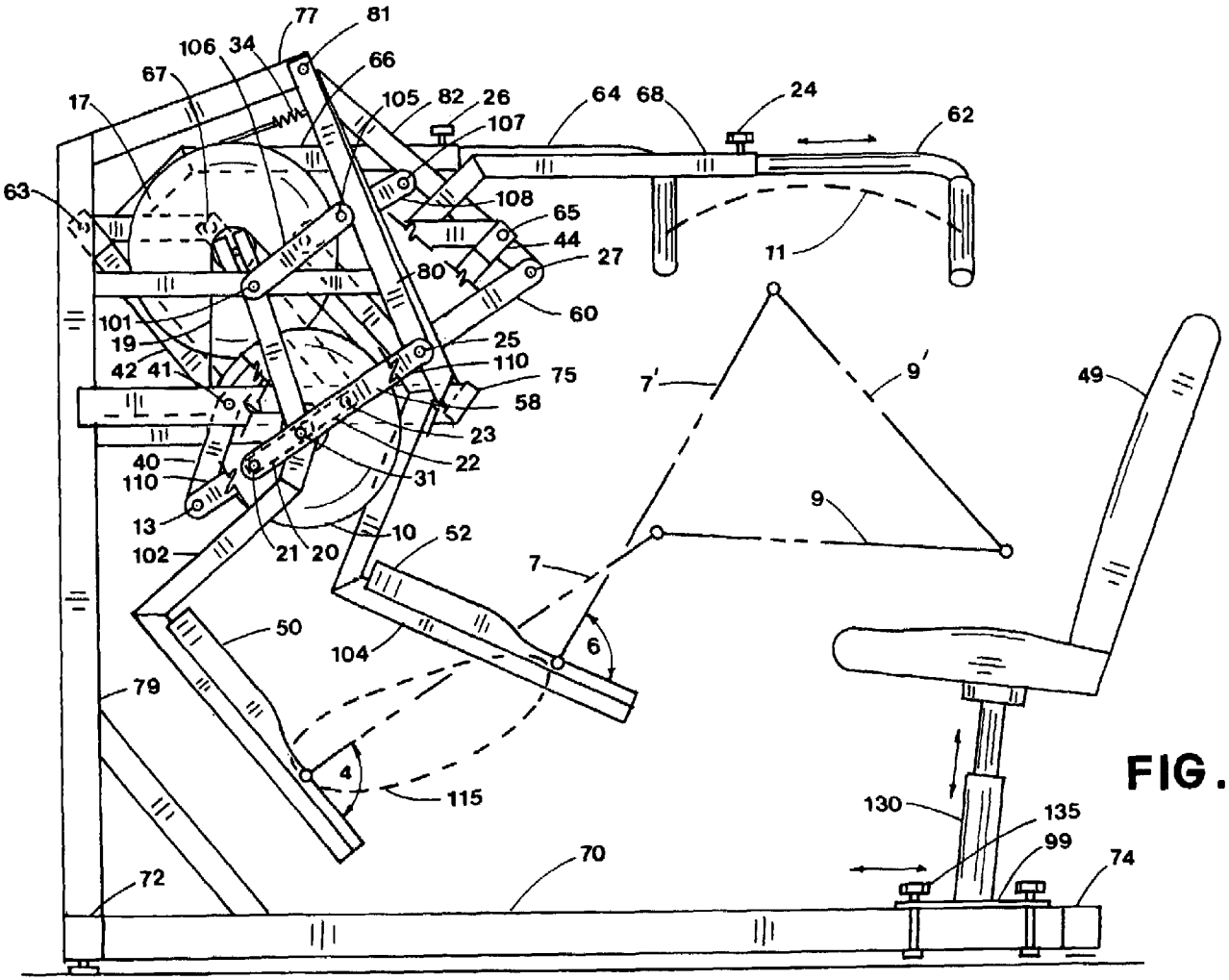
FIG. 4 is a left side elevation view of the first alternate embodiment.
Figure 5:
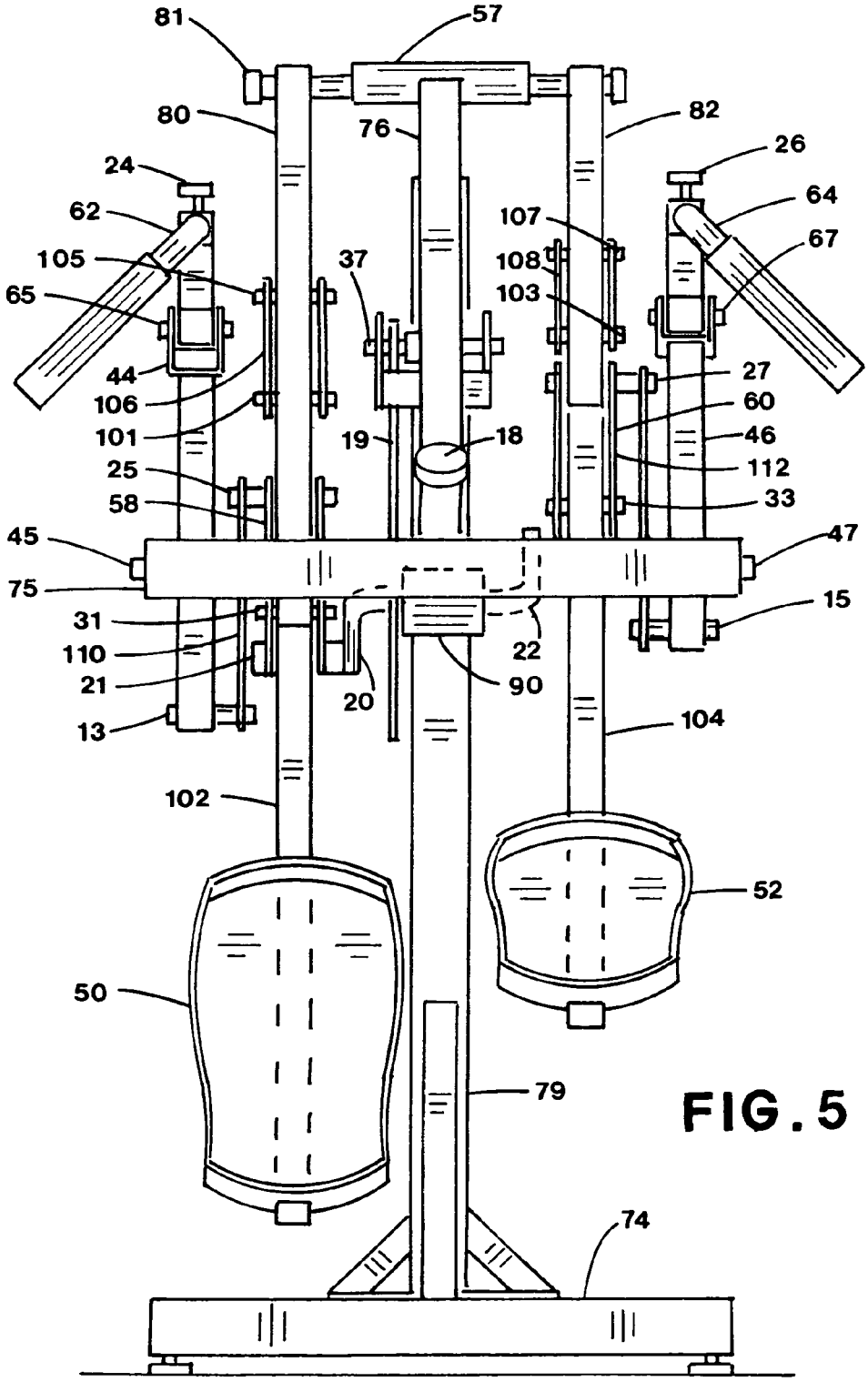
FIG. 5 is a rear view of the first alternate embodiment shown in FIG. 4 without the seat.

Referring to FIGS. 4 and 5, pedals 50, 52 are shown in their most forward and rearward positions of the first alternate embodiment. During operation of the exercise apparatus, pedals 50, 52 follow the inclined elliptical pedal curve 115. The lower leg 7 and upper leg 9 are shown in the lowermost contact with pedal 50 while lower leg 7' and upper leg 9' are shown in the uppermost contact with pedal 52. The angles 4, 6 as measured from the pedal 50, 52 surface to the lower leg 7, 7' remain close to 90 degrees during operation for effective force transfer during load but can articulate to exercise the ankle and lower leg muscles.

Handles 62, 64 follow arcuate path 11 coordinated with the movement of pedals 50, 52. Locking devices 24, 26 can be loosened to allow handles 62, 64 to slide relative to handle supports 66, 68 to bring the arcuate path 11 closer or further away from the operator as desired. Handles 60, 62 can also be removed from handle supports 66, 68 if desired. With either handle 62, 64 forward, an operator can easily step into the seat or with handles 62, 64 positioned side by side, an operator can step through from either side for easy ingress and egress.

Pedals 50, 52 are attached to foot supports 102, 104 which are connected to coupler links 58, 60 at pivots 31, 33 and to guide links 106, 108 at pivots 101, 103. Coupler links 58, 60 are connected to crank arms 20, 22 at pivots 21, 23 and to rocker links 80, 82 at pivots 25, 27. Rocker links 80, 82 are attached to frame member 57 at pivot 81. Guide links 106, 108 are pivotally connected to rocker links 80, 80 at pivots 105, 107.

Crank arms 20, 22 can be connected generally opposed in crank bearing housing 90 forming a crank pivot axis or crank arms 20, 22 can be connected so as to be non-parallel for easy start up in a toggle position of a pedal. Crank bearing housing 90 is attached to frame members 71 and 73. Crank arms 20, 22, coupler links 58, 60, and rocker links 80, 82 form a crank-rocker linkage where the pivots 31, 33 located upon coupler links 58, 60 follow an elliptical path (not shown for clarity). The elliptical motion of coupler link pivots 31, 33 impart elliptical motion to foot support members 102, 104 along with pedals 50, 52. During operation, pedals 50, 52 articulate providing modest dorsi-flexion and plantar flexion foot rotation about the ankle.

Crank arms 20, 22 and coupler links 58, 60 are shown in toggle positions in FIGS. 2 and 3. An operator seated in seat 49 with feet positioned on pedals 50, 52 could have difficulty overcoming the toggle position during startup except that pedal 52 positions lower leg 7' such that the lower leg 7' is tangent to elongate curve 115 allowing force transfer for startup.

The drive system and framework is the same as the preferred embodiment. Arm exercise is the same as the preferred embodiment except that connecting links 110, 112 are connected to rocker links 80, 82 at pivots 25, 27.

Figure 6:
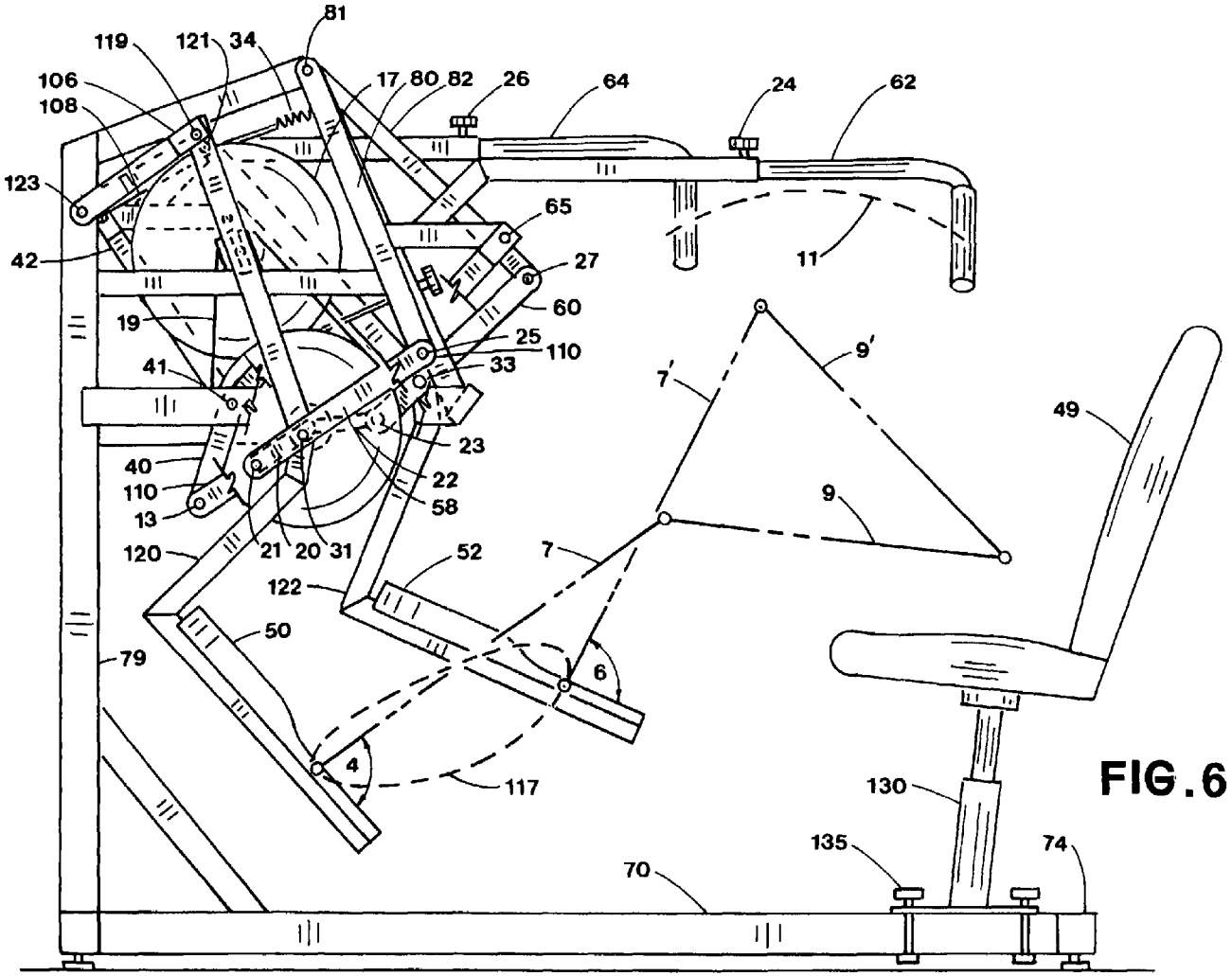
FIG. 6 is a left side elevation view of the second alternate embodiment.

Referring to FIG. 6 for the second alternate embodiment, pedal 50 is shown in the lowermost position while pedal 52 is shown off the uppermost position of the elongate curve 117. This occurs because crank arms 20 and 22 are connected at the pivot axis so as to be non-parallel. Pedal 52 positions the lower leg 7' tangent to elongate curve 117 for easy startup. Handle 64 is shown positioned off the end of arcuate path 11 allowing force transfer from the arms to aid in toggle startup. Guides 106, 108 are now connected to frame member 79 at pivot 123 and to foot supports 120, 122 at pivots 119, 121. Foot supports 120, 122 are connected to coupler links 58, 60 at pivots 31, 33 and support pedals 50, 52. Connecting links 110, 112 are connected to rocker links 80, 82 at pivots 25, 27 and to arm links 40, 42 at pivots 13, 15.

The arm exercise linkage system, drive system, and framework is similar to the preferred embodiment of FIGS. 1, 2 and 3. The seat 49 is shown in FIGS. 4 and 6 having knobs 135 which can be loosened to move seat support 130 along frame member 70.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus comprising;

a framework, a seat mounted on the framework, said framework configured to be supported by a horizontal surface and support a seated operator;

a pair of crank arms, said crank arms being connected and configured to rotate about a pivot axis connected to said framework;

a pair of coupler links, each coupler link pivotally connected to a respective said crank arm;

a pair of rocker links, each rocker link pivotally connected to to a respective said coupler link and pivotally connected to said framework;

a pair of foot supports, each said foot support pivotally connected to a respective said coupler link;

a pair of guide links, each guide link pivotally connected to a respective said foot support to guide a portion of said foot support;

a pair of pedals, each said pedal connected to a respective said foot support and operably associated with a corresponding crank arm to generate an elliptical pedal path;

said pedals configured to move relative to said framework when the foot of said seated operator is rotating said crank arms whereby said elliptical pedal path remains below said pivot axis during operation of said pedals.

2. The exercise apparatus according to claim 1 wherein said guide link is pivotally connected to a respective said rocker link.

3. The exercise apparatus according to claim 1 wherein said guide link is pivotally connected to said framework.

4. The exercise apparatus according to claim 1 further comprising a load resistance device, said load resistance device operably associated with said crank arm.

5. The exercise apparatus according to claim 1 wherein the lower leg of said operator is generally tangent to said elongate curve at the upper pedal position while the other pedal is in the lowermost position for easy startup.

6. The exercise apparatus according to claim 1 wherein said pedals remain generally perpendicular to the lower leg of said seated operator during operation of said exercise apparatus.

7. The exercise apparatus according to claim 1 further comprising arm exercise, said arm exercise operably associated with said crank arm.

8. The exercise apparatus according to claim 7 further comprising a pair of handles for arm exercise, each said handle movably connected to a handle support.

9. The exercise apparatus according to claim 8 further comprising a handle adjustment device, said handle adjustment device configured to allow said handles to be repositioned relative to said handle support to achieve handle locations that accommodate said seated operator.

10. The exercise apparatus according to claim 8 further comprising;

a pair of first arm links, each said first arm link pivotally connected to a corresponding handle support and to said framework;

a pair of second arm links, each said second arm link pivotally connected to a corresponding said handle support and said framework;

a pair of connector links, each said connector link pivotally connected to a corresponding said first arm link and said rocker link whereby said handle follows an arcuate curve.

11. The exercise apparatus according to claim 1 wherein the position of said seated operator may be adjusted relative to said framework.

12. The exercise apparatus according to claim 1 wherein said crank arms are connected at said pivot axis to be non-parallel for improved pedal startup.

13. An exercise apparatus comprising;

a framework, a seat mounted on the framework, said framework configured to be supported by a generally flat surface and support a seated operator;

a pair of crank arms, said crank arms being connected and configured to rotate about a pivot axis connected to said framework;

a pair of rocker links, each said rocker link pivotally connected to said framework;

a pair of coupler links, each coupler link pivotally connected to a respective said crank arm and a respective said rocker link;

a pair of foot supports, each said foot support having a foot engaging pedal and pivotally connected to a respective said coupler link;

a pair of guide links, each said guide link pivotally connected to a respective said rocker link and to a respective said foot support;

said pedals configured to move relative to said framework when the foot of said seated operator is rotating said crank arms whereby said pedals follow an elongate closed loop path positioned below said pivot axis.

14. The exercise apparatus according to claim 13 further comprising a pair of handles for arm exercise, each said handle operably associated with a corresponding said rocker link.

15. The exercise apparatus according to claim 13 further comprising a step through region, said step through region positioned between said pedals and said seated operator whereby said step through region is link free for easy ingress and egress of said operator.

16. The exercise apparatus according to claim 13 wherein said crank arms are connected at said pivot axis to be non-parallel for improved pedal startup.

17. An exercise apparatus comprising;

a framework, a seat mounted on the framework, said framework configured to be supported by a generally flat surface and support a seated operator;

a pair of crank arms, said crank arms being connected and configured to rotate about a pivot axis connected to said framework;

a pair of linkages, each said linkage positioned forward said seated operator, pivotally connected to a corresponding said crank arm and operably associated with said framework;

a pair of foot supports, each foot support operably associated with a corresponding said linkage;

a pair of guide links, each said guide link pivotally connected to a respective said foot support and to said framework;

a pair of pedals, each said pedal attached to a corresponding said foot support and configured to follow an elongate closed loop pedal path; said closed loop pedal path remains below the pivot axis;

said pedals configured to move relative to said framework when the foot of said seated operator is rotating said crank arms along said elongate pedal path whereby the heel of said operator generally remains on said pedal during operation of said apparatus.

18. The exercise apparatus according to claim 17 further comprising;

a pair of handles for arm exercise, each said handle associated with a handle support;

a pair of first arm links, each said first arm link pivotally connected to a corresponding handle support and to said framework;

a pair of second arm links, each said second arm link pivotally connected to a corresponding said handle support and said framework;

a pair of connector links, each said connector link pivotally connected to a corresponding said first arm link and said linkage whereby said handle follows an arcuate curve.

19. The exercise apparatus according to claim 17 wherein said crank arms are connected at said pivot axis to be non-parallel for improved pedal startup.

20. The exercise apparatus according to claim 17 wherein the lower leg of said operator is generally tangent to said elongate curve at the upper pedal position while the other pedal is in the lowermost position for easy startup.

* * * * *